US006378407B1

(12) United States Patent
Purkapile

(10) Patent No.: US 6,378,407 B1
(45) Date of Patent: Apr. 30, 2002

(54) MULTIBLADE SCREWDRIVER

(75) Inventor: Emerson Purkapile, Scottsdale, AZ (US)

(73) Assignee: Wilton Tool Company, LLC, Palatine, IL (US)

( * ) Notice: Subject to any disclaimer, the term of this patent is extended or adjusted under 35 U.S.C. 154(b) by 0 days.

(21) Appl. No.: 09/608,156

(22) Filed: Jun. 30, 2000

Related U.S. Application Data

(63) Continuation-in-part of application No. 09/209,766, filed on Dec. 11, 1998, now abandoned.

(51) Int. Cl.[7] ..... B25G 1/08
(52) U.S. Cl. ..... 81/490; 81/177.4
(58) Field of Search ..... 81/177.4, 438, 81/490

(56) References Cited

U.S. PATENT DOCUMENTS 4,241,773 A * 12/1980 Personnat ..... 81/490
4,463,788 A * 8/1984 Corona et al. ..... 81/490
4,552,043 A * 11/1985 Corona et al. ..... 81/490
4,552,044 A * 11/1985 Corona et al. ..... 81/490
4,716,795 A * 1/1988 Corona et al. ..... 81/177.4
4,716,796 A * 1/1988 Corona et al. ..... 81/177.4

* cited by examiner

*Primary Examiner*—James G. Smith
(74) *Attorney, Agent, or Firm*—Fitch, Even, Tabin & Flannery

(57) ABSTRACT

A hand-held screwdriver assembly having interchangeable blades which are held within a hollow handle and are available to be selected and moved through a cross-slot in a cap assembly on the handle to a stop position, and then to be secured in a chuck for use. Rotation of the cap assembly is prevented when the blade is secured in the chuck, thus precluding the introduction of a second blade into the cross-slot.

12 Claims, 4 Drawing Sheets

MULTIBLADE SCREWDRIVER

This application is a continuation-in-part of U.S. application Ser. No. 09/209,766 filed Dec. 11, 1998 now abandoned.

FIELD OF THE INVENTION

The invention relates to hand-held screwdrivers having interchangeable blades which are held within the handle and are available to be selected for various types of screws such as those having a straight slot, Phillips head, etc. Alternatively, the blades can be adapted to receive sockets or other shapes to hold or drive various types of fasteners.

DESCRIPTION OF RELATED ART

There are and have been on the market multiblade screwdrivers which are simply units with a hollow handle in which a number of screw driver blades are stored, and with a removable cap so that the blades can be removed and affixed to one end of the handle in operative position. These have the negative factor of loose blades which can be readily removed and misplaced.

Other forms of multiblade screw drivers are illustrated by U.S. Pat. Nos. 4,463,788; 4,716,796; 4,557,943 and 5,228,363. All of these have multiple, usually six, screwdriver blades or shafts which are mounted in multiple peripheral openings or storage slots disposed lengthwise on the outer portion of the handle. The operator can select the desired blade located in the storage portion of the handle and slide it forward toward an operative position. The blade moves forward through the storage slot to the forward end of the handle until it reaches a point where a stopping mechanism on the base of the blade engages the inside of the cap and prevents the blade from falling out. The blade is then in the outer portion of a cross slot in the cap perpendicular to and above the storage slot. It can be moved in the cross slot toward the center of the handle and when in the center, moved toward the back of the handle into a chuck element, generally having a magnet in its base, which holds the blade in operative position on the central axis of the screwdriver assembly. Shaped portions in the base of the blade engage correspondingly shaped portions of the chuck to prevent rotation of the blade when it is in the chuck. This permits a downward, twisting force to be exerted on the blade/handle combination to engage the fastener and prevent rotation of the blade in the handle to permit screwing or unscrewing of the fastener.

In the prior art devices, the cross slot through which the blade moves from storage to operative position in the chuck is composed of two parts, a slot in the top of the cap which encloses the forward end of the handle and a corresponding slotted portion in a rotatable disk which can rotate within the cap. When moving the blade from storage to operative position, the cross slots are lined up to permit the movement of the selected blade from the storage to the operative position or vice versa. To retain the blade in the chuck and prevent movement of the blade either outward or within the slot, the disk is rotated, perhaps 90 degrees, so that the disk having the slot no longer is lined up with the slot in the cap and thus the blade is held or locked in place in the chuck.

SUMMARY OF THE INVENTION

It is an object of the invention to prevent rotation of the cap assembly when the blade is in the chuck, thus precluding the introduction of a second blade into the cross-slot which can occur in prior art devices because a user's hands gripping the handle and twisting the screwdriver can fairly easily rotate and unlock the exposed lock ring on the disk mounted in the forward end of the handle.

It is a further object of the invention to construct a multiblade screwdriver with the use of fewer and simpler parts while providing the same ability to move from storage to operative position, to retain the blade within the handle and to move to the operative position, locking the blade into the operative position.

Applicant's improved construction provides for a blade of simple polygonal, and preferably hexagonal, cross sectional configuration, eliminating relatively expensive forming or machining steps required to make the blade configuration in the prior art devices. Thus, the blade configuration can be formed from a hexagonal length of steel or like metal having a screwdriver shape or configuration at the outer end. The portion near the inner end has a flat notch cut in opposite sides of the hex, preferably in angled portions. This notch is cut across the hex on two portions of the hex opposite each other to form a flat sided notch which will enable the blade to slide along a track portion of the opening which is formed in the cap. A lug or "wing" is formed on the inside base portion of the blade adjacent one or both of the flat notched portions for the purpose of engaging the inside of the cap adjacent to the hex opening track portions to prevent the blade from being removed from the handle.

DETAILED DESCRIPTION OF INVENTION

Figure 1:
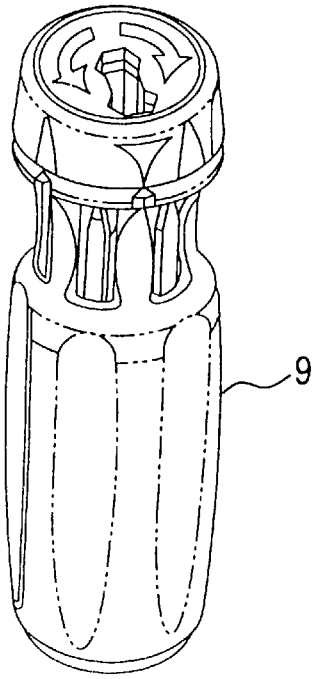
FIG. 1 is a perspective view of a screwdriver assembly according to the invention with the blades retracted into the handle.
Figure 2:
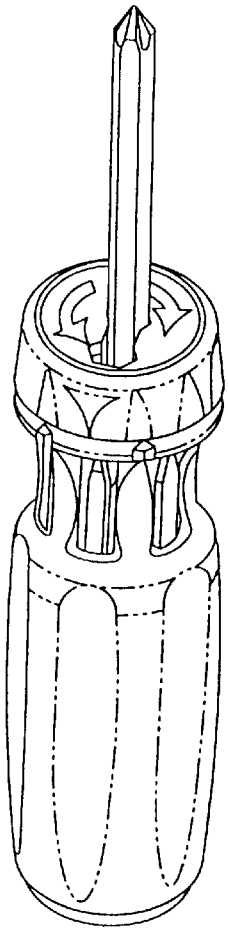
FIG. 2 is a perspective view of the screwdriver assembly of FIG. 1, with a blade extended into operative position.
Figure 3:
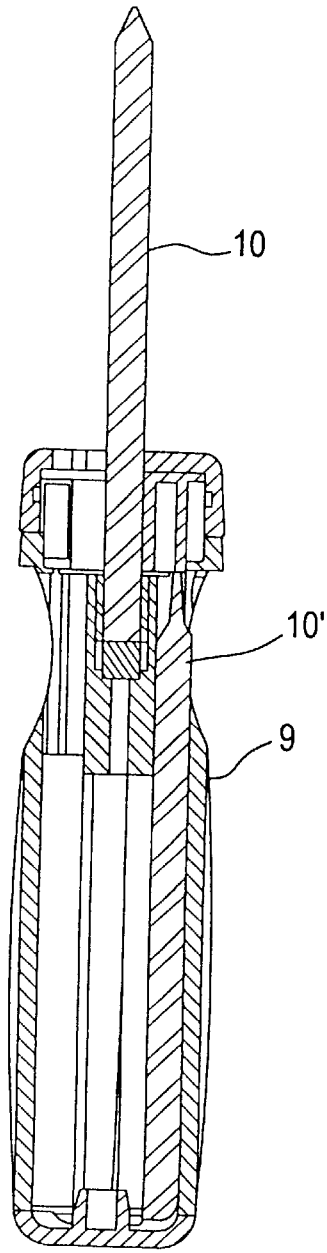
FIG. 3 is a vertical cross-sectional view of the screwdriver assembly of FIG. 2.
Figure 4:
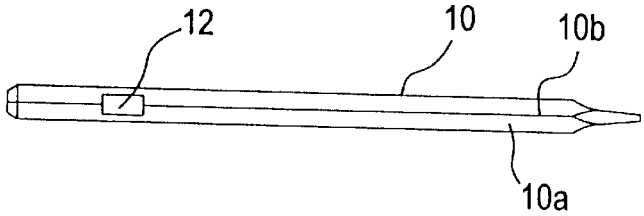
FIG. 4 is a side view of one of the blades of the screwdriver assembly of the invention.
Figure 5:
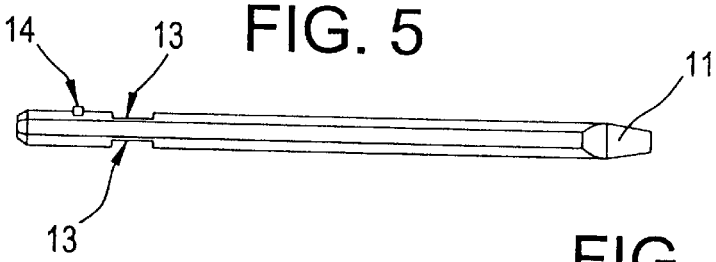
FIG. 5 is a side view of the blade of FIG. 4 rotated 90°.
Figure 8:
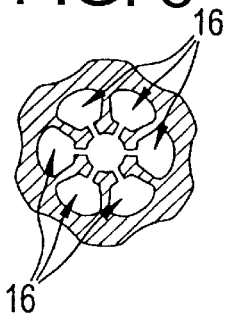
FIG. 8 is a cross-sectional view taken substantially along line B—B of FIG. 6.
Figure 9:
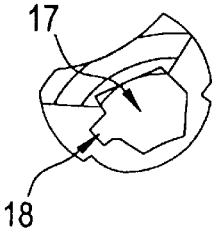
FIG. 9 is an enlarged detail of a blade storage slot according to the invention.
Figure 7:
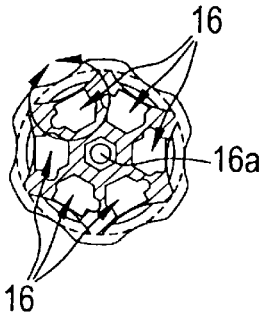
FIG. 7 is a cross-sectional view taken substantially along line A—A of FIG. 6.

The screwdriver assembly of the invention, as shown in FIGS. 1, 2 and 3 has a handle 9 and a plurality of interchangeable blades 10. FIG. 1 shows the handle 9 with all blades retracted and in the storage position, while FIG. 2 shows the screwdriver assembly with a blade 10 in an operative position. FIG. 3 is a cross-section of the screwdriver assembly with one blade 10 in operative position extending through the cap and another slotted blade 10' in a storage position. The blades 10 are formed from hexagonal steel segments shown in FIGS. 4 and 5, having flat surfaces 10*a* connected by angle portions 10*b*, and having a flat screwdriver tip 11 formed at the forward end of the blade. In the preferred embodiment shown in FIGS. 4 and 5, two opposing notches near the back end of the blade are formed by cutting opposing angle portions 12 of the hex to form flat guide surfaces 13 in the hex; a projection-stop means 14 is formed rearward of and adjacent to one of the slots 13. Cutting the notches in the angle portions of the blade enables a reduction in the diameter of the handle. The projection stop-means 14 is adapted to go through the blade slot openings 16 and 17 shown in FIGS. 7, 8 and 9, and to engage the retainer/cap assembly at 28, shown in FIG. 14, to prevent it from being withdrawn from the handle.

Figure 6:
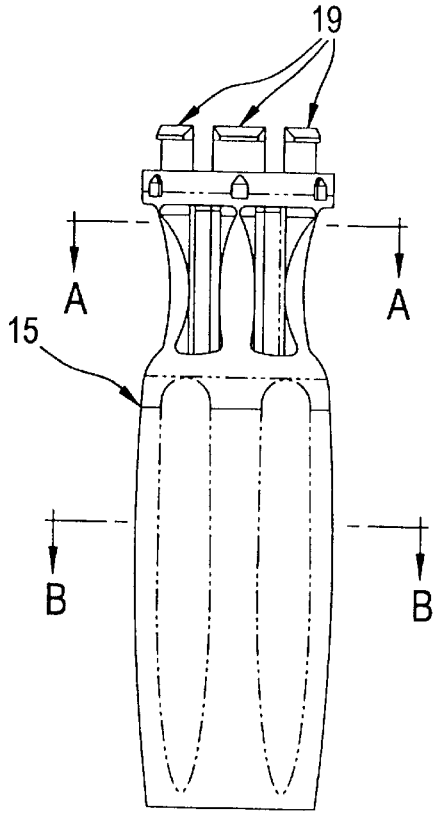
FIG. 6 it is an elevational view of a screwdriver handle of the invention with its cap removed.

The handle 15 has a plurality of peripheral storage slots 16 to hold the hexagonal blades disposed around the periphery of the handle parallel to the central axis of the handle which includes a chuck 16*a* for receiving a blade in its operative position. The blade storage slot opening viewed from the upper end has a configuration 17 which holds in sliding engagement the hexagonal blades with a projection receiving slot 18 which receives and guides the projection-stop means 14 in the blade. The handle 15 in FIG. 6 has cap receiving tabs 19 which are adapted to hold a cap on the forward end of the handle.

Figure 10:
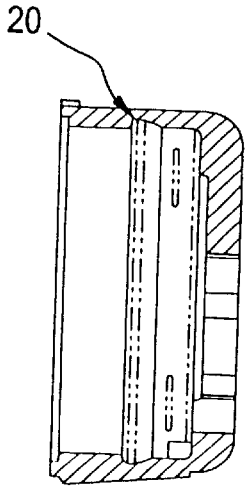
FIG. 10 is an enlarged cross-sectional view of a screwdriver cap according to the invention.
Figure 11:
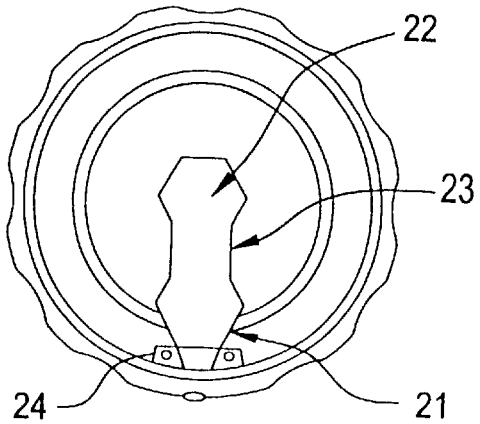
FIG. 11 is a bottom view of the cap of FIG. 10.

FIG. 10 is a cross-section of a cap having an internal groove 20 which rotatably engages tabs 19 to enable the cap to rotate on the forward portion of the handle. FIG. 11 shows the inside of the cap, having a blade guiding opening including hex portion 21 which receives a blade from the storage position or returns it to the storage position. A hex portion 22 disposed in the center above the retainer disc 25 shown in FIG. 13 and an intermediate opening slot 23 which connects the two hex portions 21 and 22. The width of the slot 23 corresponds to the distance between the two faces of flat slot 13 in FIG. 5.

Figure 12:
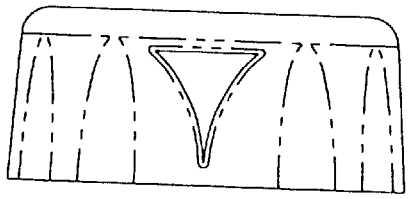
FIG. 12 is an elevational view of the cap of FIG. 10.

FIG. 12 is a side view of the cap showing an arrow which can be lined up with the blades in the storage position in the handle to move or return blades from the storage position to the chuck position.

Figure 13:
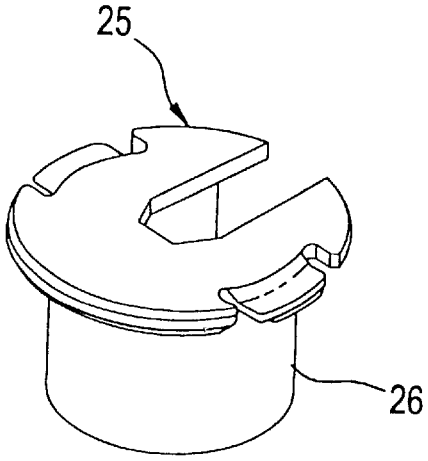
FIG. 13 is a top perspective view of a retainer of the screwdriver assembly of the invention.
Figure 14:
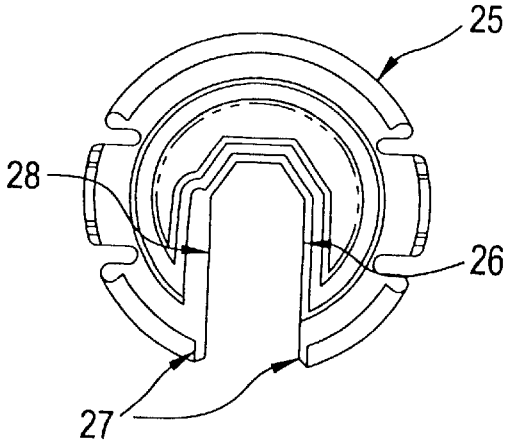
FIG. 14 is a bottom view of the retainer of FIG. 13.

FIGS. 13 and 14 show a retainer which includes a disk portion 25 and a depending blade guide portion 26 of which outside portions 27 engage stop projections 24 in the cap, as shown in FIG. 11, to prevent the disk portion which fits in the cap from rotating relative to the cap.

The blade guide portion 26 of the retainer guides the base of the blade being introduced to the chuck. When the blade is in an operative position in the chuck 16*a*, the retainer/cap assembly is prevented from rotating because the hex blade portion which is in the hex shaped chuck can not rotate with respect to the handle and because the hex opening of the cap and the retainer are also hex shaped, thus preventing everything from rotating until the blade is withdrawn from the chuck when it is being returned to the storage position via hex portions 21 and 22, and slot 23, from a blade position in hex portion 22 to the storage position which would be lined up with hex portion 21.

Figure 15:
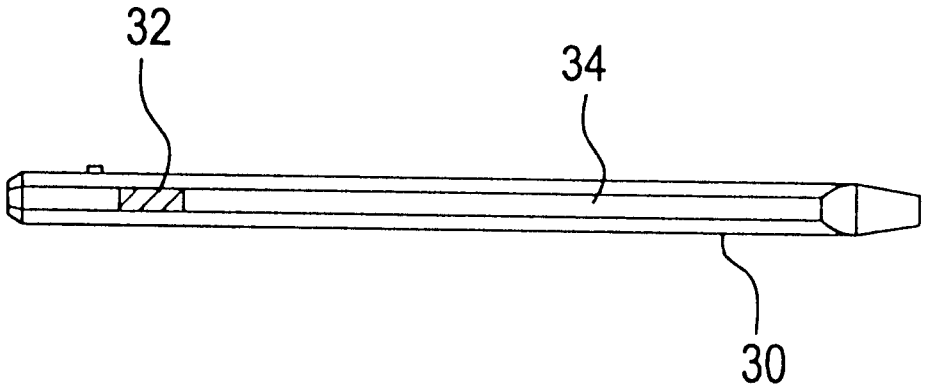
FIG. 15 is a top view of an alternate embodiment of a blade of the invention.
Figure 16:
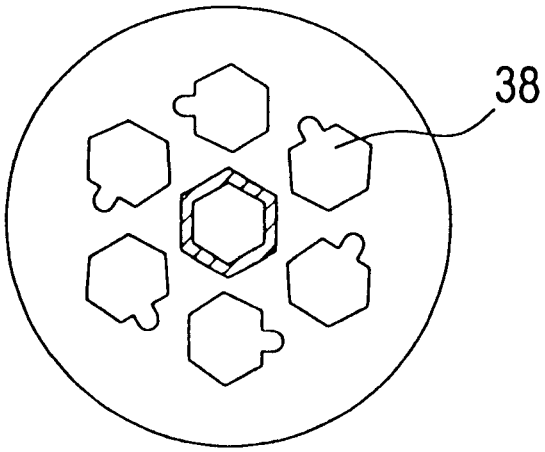
FIG. 16 is a cross-sectional view taken substantially along line A—A of the handle of FIG. 6, in an alternate embodiment used with the blade of FIG. 15.

In the embodiment shown in FIGS. 15 and 16, a blade 30 is formed with notches 32 cut in flat portions 34. While the operation of this screwdriver assembly is essentially the same as the operation of the previously described embodiment, a larger diameter handle is required for the same complement of blades, as can be seen in the arrangement of slots 38 in FIG. 16.

What is claimed is:

1. A screwdriver assembly comprising a handle and interchangeable blades, each of said blades having a shaft of a polygonal cross-section and having forward and back ends with a screwdriver tip formed at the forward end and two opposed flats in spaced adjacent relation to the back end and formed in opposing angled portions of the shaft of polygonal cross-section, wherein a flat guide surface of reduced width is formed, a projection stop on each of said blades rearward of and adjacent to the one of said flats, said handle having a forward end with plurality of polygonal storage slots opening therethrough for receiving the blades in a storage position, said storage slots having a groove to receive and guide the projection stop on the blades, said slots having axes parallel to a center axis of the handle, said handle including a blade receiving chuck at a central part of its forward end and a cap on the forward end of the handle and over the storage slots, blade guide means in the cap for guiding a selected blade from a storage slot to the chuck and for returning each of said blades to a storage position, said cap being rotatable to line up the blade guide means over a selected blade or to an intermediate position to enclose the blades within the handle, said handle further including means for preventing rotation of said cap when a blade is secured in said chuck.

2. The screwdriver assembly of claim 1, wherein the blades and the storage slots are of hexagonal cross-section.

3. A screwdriver assembly comprising a handle and interchangeable blades, each of said blades having a shaft of a polygonal cross-section and having forward and back ends with a screwdriver tip formed at the forward end and two opposed flats in spaced adjacent relation to the back end and formed in opposing angled portions of the shaft of polygonal cross-section, wherein a flat guide surface of reduced width is formed, a projection stop on each of said blades rearward of and adjacent to the one of said flats, said handle having a forward end with plurality of polygonal storage slots opening therethrough for receiving the blades in a storage position, said storage slots having a groove to receive and guide the projection stop on the blades, said slots having axes parallel to a center axis of the handle, said handle comprising a blade receiving chuck at a central part of its forward end, a cap assembly rotatably mounted on the forward end of the handle and movable between a first position where a preselected blade may be withdrawn or returned to a storage slot and a second intermediate position preventing withdrawal of blades from their storage position, said cap assembly comprising a cap adapted to fit over the forward end of the handle and an inner retainer comprising a disk portion which fits inside the cap with a blade guide portion extending inward relative to the cap, said retainer having means for preventing rotation of the retainer with respect to the cap, an opening in the cap assembly comprising three portions, a polygonal opening in an outer portion of the cap rotatable to a position over the storage slots in the handle and adapted to receive a selected blade, an inner polygonal opening located over the chuck and a connecting slot of constant dimensions narrower than the shaft of polygonal cross-section and functioning as a track to engage the flats of the blade, to guide the blade between the storage position and the blade position in the chuck, said connecting slot guiding the blade from the storage position when the polygonal opening in the outer portion of the cap is rotated to a position over the storage area holding one of said blades and reversing one of said blades from the blade position in the chuck back to the storage position, said connecting slot in conjunction with the flats in the blades retaining the blades during the transition from storage to use, said cap opening having means adjacent to the hexagonal openings for engaging the projection stop located adjacent the back of the blades to prevent the blades front being withdrawn from the handle when all blades are in the storage position or one of said blades is in the blade position in the chuck, said cap assembly being rotatable with respect to the handle to line up with the storage slot of a preselected blade, the blade being withdrawable from the storage position to an outer stop position where the blade projection stop engages the stop in the cap assembly.

4. The screwdriver assembly of claim 3, wherein the blades and the storage slots are of hexagonal cross-section.

5. A screwdriver assembly comprising a handle and interchangeable blades, each of said blades having a shaft of a polygonal cross-section comprising flat surfaces and angled portions, and having forward and back ends with a screwdriver tip formed at the forward end and two opposed flats in spaced adjacent relation to the back end and formed in opposing portions of the shaft of polygonal cross-section, wherein a flat guide surface of reduced width is formed, a projection stop on each of said blades rearward of and adjacent to the one of said flats, said handle having a forward end with plurality of polygonal storage slots opening therethrough for receiving the blades in a storage position, said storage slots having a groove to receive and guide the projection stop on the blades, said slots having axes parallel to a center axis of the handle, said handle including a blade receiving chuck at a central part of its forward end and a cap on the forward end of the handle and over the storage slots, blade guide means in the cap for guiding a selected blade from a storage slot to the chuck and for returning each of said blades to a storage position, said cap being rotatable to line up the blade guide means over a selected blade or to an intermediate position to enclose the blades within the handle, said handle further including means for preventing rotation of said cap when a blade is secured in said chuck.

6. The screwdriver assembly of claim 5, wherein the blades and the storage slots are of hexagonal cross-section.

7. The screwdriver assembly of claim 5, wherein the opposed flats are formed in the angled portions of the shaft.

8. The screwdriver assembly of claim 5, wherein the opposed flats are formed in the flat surfaces of the shaft.

9. A screwdriver assembly comprising a handle and interchangeable blades, each of said blades having a shaft of a polygonal cross-section comprising flat surfaces and angled portions, and having forward and back ends with a screwdriver tip formed at the forward end and two opposed flats in spaced adjacent relation to the back end and formed in opposing portions of the shaft of polygonal cross-section, wherein a flat guide surface of reduced width is formed, a projection stop on each of said blades rearward of and adjacent to the one of said flats, said handle having a forward end with plurality of polygonal storage slots opening therethrough for receiving the blades in a storage position, said storage slots having a groove to receive and guide the projection stop on the blades, said slots having axes parallel to a center axis of the handle, said handle comprising a blade receiving chuck at a central part of its forward end, a cap assembly rotatably mounted on the forward end of the handle and movable between a first position where a preselected blade may be withdrawn or returned to a storage slot and a second intermediate position preventing withdrawal of blades from their storage position, said cap assembly comprising a cap adapted to fit over the forward end of the handle and an inner retainer comprising a disk portion which fits inside the cap with a blade guide portion extending inward relative to the cap, said retainer having means for preventing rotation of the retainer with respect to the cap, an opening in the cap assembly comprising three portions, a polygonal opening in an outer portion of the cap rotatable to a position over the storage slots in the handle and adapted to receive a selected blade, an inner polygonal opening located over the chuck and a connecting slot of constant dimensions narrower than the shaft of polygonal cross-section and functioning as a track to engage the flats of the blade, to guide the blade between the storage position and the blade position in the chuck, said connecting slot guiding the blade from the storage position when the polygonal opening in the outer portion of the cap is rotated to a position over the storage area holding one of said blades and reversing one of said blades from the blade position in the chuck back to the storage position, said connecting slot in conjunction with the flats in the blades retaining the blades during the transition from storage to use, said cap opening having means adjacent to the hexagonal openings for engaging the projection stop located adjacent the back of the blades to prevent the blades from being withdrawn from the handle when all blades are in the storage position or one of said blades is in the blade position in the chuck, said cap assembly being rotatable with respect to the handle to line up with the storage slot of a preselected blade, the blade being withdrawable from the storage position to an outer stop position where the blade projection stop engages the stop in the cap assembly.

10. The screwdriver assembly of claim 9, wherein the blades and the storage slots are of hexagonal cross-section.

11. The screwdriver assembly of claim 9, wherein the opposed flats are formed in the angled portions of the shaft.

12. The screwdriver assembly of claim 9, wherein the opposed flats are formed in the flat surfaces of the shaft.

* * * * *